US009188336B2

(12) United States Patent
Chen et al.

(10) Patent No.: US 9,188,336 B2
(45) Date of Patent: Nov. 17, 2015

(54) ASSEMBLIES AND APPARATUS RELATED TO COMBUSTOR COOLING IN TURBINE ENGINES

(71) Applicant: General Electric Company, Schenectady, NY (US)

(72) Inventors: Wei Chen, Greer, SC (US); Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 431 days.

(21) Appl. No.: 13/665,236

(22) Filed: Oct. 31, 2012

(65) Prior Publication Data

US 2014/0116058 A1 May 1, 2014

(51) Int. Cl.

| | |
|---|---|
| ***F02C 7/18*** | (2006.01) |
| ***F23R 3/54*** | (2006.01) |
| ***F23R 3/00*** | (2006.01) |
| ***F23R 3/06*** | (2006.01) |

(52) U.S. Cl.

CPC . *F23R 3/002* (2013.01); *F23R 3/06* (2013.01); *F23R 3/54* (2013.01); *F23R 2900/03044* (2013.01)

(58) Field of Classification Search

CPC ..... F02C 7/18; F02C 7/12; F23R 3/54
USPC ..... 60/754, 806
See application file for complete search history.

(56) References Cited

U.S. PATENT DOCUMENTS

| | | | | |
|---|---|---|---|---|
| 4,719,748 | A | 1/1988 | Davis, Jr. et al. | |
| 5,419,115 | A * | 5/1995 | Butler et al. | 60/804 |
| 2008/0115498 | A1 * | 5/2008 | Patel et al. | 60/752 |
| 2010/0031665 | A1 | 2/2010 | Chokshi et al. | |
| 2010/0037622 | A1 | 2/2010 | Simo et al. | |
| 2010/0251723 | A1 | 10/2010 | Chen et al. | |
| 2011/0107766 | A1 | 5/2011 | Davis, Jr. et al. | |

OTHER PUBLICATIONS

European Search Report and Written Opinion issued in connection with corresponding EP Application No. 13190340.3-1602 on Jan. 2, 2014.

* cited by examiner

*Primary Examiner* — Phutthiwat Wongwian
*Assistant Examiner* — Filippo Manfredi
(74) *Attorney, Agent, or Firm* — Mark E. Henderson; Ernest G. Cusick; Frank A. Landgraff

(57) ABSTRACT

A combustor of a combustion turbine engine is described. The combustor may include an inner radial wall, which defines a combustion chamber downstream of a primary fuel nozzle, and an outer radial wall, which surrounds the inner radial wall so to form a flow annulus therebetween, and the combustor may include a socket extending from the outer radial wall into the flow annulus. The socket may include: a mouth formed through the outer radial wall; a floor offset a predetermined distance from an outboard surface of the inner radial wall; impingement ports formed through the floor; and an axial nozzle.

22 Claims, 6 Drawing Sheets

ASSEMBLIES AND APPARATUS RELATED TO COMBUSTOR COOLING IN TURBINE ENGINES

BACKGROUND OF THE INVENTION

This invention relates to combustors in combustion turbine engines and, specifically, to the cooling of combustor components, such as the liner, in such engines.

Conventional gas turbine combustion systems employ multiple combustor assemblies to achieve reliable and efficient turbine operation. Each combustor assembly includes a cylindrical liner, a fuel injection system, and a transition piece that guides the flow of the hot gas from the combustor to the inlet of the turbine. Generally, a portion of the compressor discharge air is used to cool the combustion liner and transition piece, and is then introduced into the combustor reaction zone to be mixed with the fuel and burned.

In systems incorporating impingement cooled transition pieces, a hollow impingement sleeve surrounds the transition piece, and the impingement sleeve wall is perforated so that compressor discharge air will flow through the cooling apertures in the sleeve wall and impinge upon (and thus cool) the transition piece. This cooling air then flows along an annulus between the sleeve surrounding the transition piece, and the transition piece itself. This so-called "cross flow" eventually flows into another annulus between the combustion liner and a surrounding flow sleeve. The flow sleeve is also formed with several rows of cooling holes around its circumference, the first row located adjacent a mounting flange where the flow sleeve joins to the outer sleeve of the transition piece. The cross flow is perpendicular to impingement cooling air flowing through the holes in the flow sleeve toward the combustor liner surface.

The presence of this cross flow negatively impacts the cooling effectiveness of the impinge coolant entering through the impingement sleeve and the flow sleeve. This effect is greater as the coolant moves toward the forward end of the combustor because of the increased cross flow through the annulus and has a particularly strong influence on the cooling effectiveness in the zone near where the first row of jets in the flow sleeve would have been expected to impingement cool the combustor liner. Specifically, the cross flow impacts the first row of flow sleeve jets, bending them over and degrading their ability to impinge upon the liner. In addition, the cooling effectiveness of the cross flow itself is reduced once the flow assumes an almost purely axial flow direction, which tends to occur as the coolant moves toward the forward end of the combustor and into the annulus surrounding the liner.

The low heat transfer rate can lead to high liner surface temperatures within the liner and transition piece and, ultimately, loss of material strength. Several potential failure modes due to the high temperature of the liner include, hut are not limited to, cracking of the aft sleeve weld line, bulging and triangulation. These mechanisms shorten the life of the liner and/or the transition piece, requiring replacement of the part prematurely. As a result, there is a need for improved cooling systems in this region of the turbine.

BRIEF DESCRIPTION OF THE INVENTION

The present invention thus describes a cooling configuration within a combustor of a combustion turbine engine. The combustor includes an inner radial wall, which defines a combustion chamber downstream of a primary fuel nozzle, and an outer radial wall, which surrounds the inner radial wall so to form a flow annulus therebetween, and a socket extending from the outer radial wall into the flow annulus. The socket may include: a mouth formed through the outer radial wall; a floor offset a predetermined distance from an outboard surface of the inner radial wall; impingement ports formed through the floor; and an axial nozzle.

The present application further describes a combustor in a combustion turbine engine, the combustor including an inner radial wall, which defines a combustion chamber downstream of a primary fuel nozzle; an outer radial wall, which surrounds the inner radial wall so to form a flow annulus therebetween; and a cooling assembly. The cooling assembly may include a socket that extends from the outer radial wall into the flow annulus. The socket may have: a mouth formed through the outer radial wall; a floor of the socket that is positioned a predetermined offset distance from an outboard surface of the inner radial wall; impingement ports formed through the floor; and an axial nozzle that includes a tube stretching between an inlet port formed on an upstream side of the socket and an outlet port, the axial nozzle having an inboard cant. These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
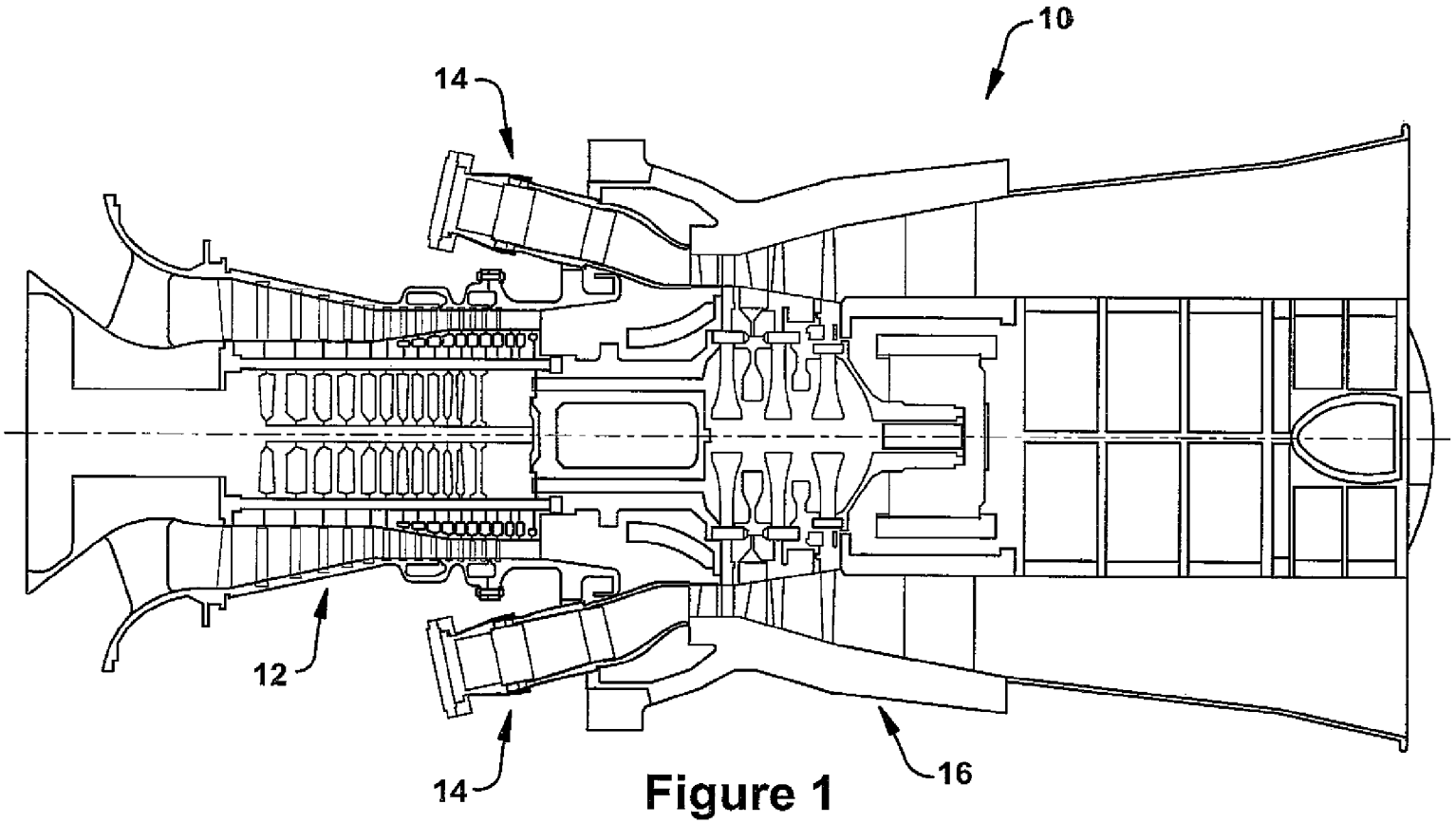
Figure 1 (Prior Art)
FIG. 1 is a cross-sectional view of a combustion turbine engine in which embodiments of the present invention may be used.

As an initial matter, in communicating the nature of the present invention, it may be necessary to select terminology that refers to and describes certain parts or machine components within a combustion turbine engine. Whenever possible, common industry terminology will be used and employed in a manner consistent with its accepted meaning. However, it is intended that any such terminology should be given a broad meaning and not narrowly construed such that the meaning intended herein and the scope of the appended claims is unreasonably restricted. Those of ordinary skill in the art will appreciate that often a particular component may be referred to using several different terms. In addition, what may be described herein as being single part may include and be referenced in another context as consisting of multiple components, or, what may be described herein as including multiple components may be referred to elsewhere as a single part. As such, in understanding the scope of the present invention, attention should not only be paid to the terminology and description provided herein, but also to the structure, configuration, function, and/or usage of the component, particularly as provided in the appended claims.

In addition, several descriptive terms may be used regularly herein, and it may prove helpful to define these terms at the onset of this section. Accordingly, these terms and their definitions, unless stated otherwise, are as follows. As used herein, "downstream" and "upstream" are terms that indicate a direction relative to the usual direction of flow of a fluid in the turbine engine. For example, these terms may be used in relation to the primary flow of working fluid moving through the turbine engine. In another case, for example, these terms may be used in relation to a typical direction of flow of compressed air within the combustor or, for example, a direction of flow of a coolant through a component of the turbine engine. In this regard, the term "downstream" corresponds to the direction that the fluid typically flows through a particular passage, and the terra "upstream" refers to the direction opposite that flow. The terms "forward" and "aft", without any further specificity, refer to directions relative to the forward and aft end of the turbine engine. Specifically, "forward" refers to the forward or compressor end of the engine, and "aft" refers to the aft or turbine end of the engine. Accordingly, in the case of the combustor, it will be appreciated that the forward end corresponds generally to the head end of the combustor, and the aft end corresponds to the transition piece and, more specifically, to the outlet of the transition piece where combustion products enter the turbine section of the engine.

Additionally, the term "radial" refers to movement or position perpendicular to an axis. It is often required to describe parts that are at differing radial positions with regard to a center axis. In cases such as this, if a first component resides closer to the axis than a second component, it will be stated herein that the first component is "radially inward" or "inboard" of the second component. If, on the other hand, the first component resides further from the axis than the second component, it will be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine, or, when referring to components within a combustor of the type discussed in the present application, the center axis of the combustor.

FIG. 1 is an illustration showing a typical combustion turbine system 10. The gas turbine system 10 includes a compressor 12, which compresses incoming air to create a supply of compressed air, a combustor 14, which burns fuel so as to produce a high-pressure, high-velocity hot gas, and a turbine 16, which extracts energy from the high-pressure, high-velocity hot gas entering the turbine 16 from the combustor 14 using turbine blades, so as to be rotated by the hot gas. As the turbine 16 is rotated, a shaft connected to the turbine 16 is caused to be rotated as well, the rotation of which may be used to drive a load. Finally, exhaust gas exits the turbine 16.

Figure 2:
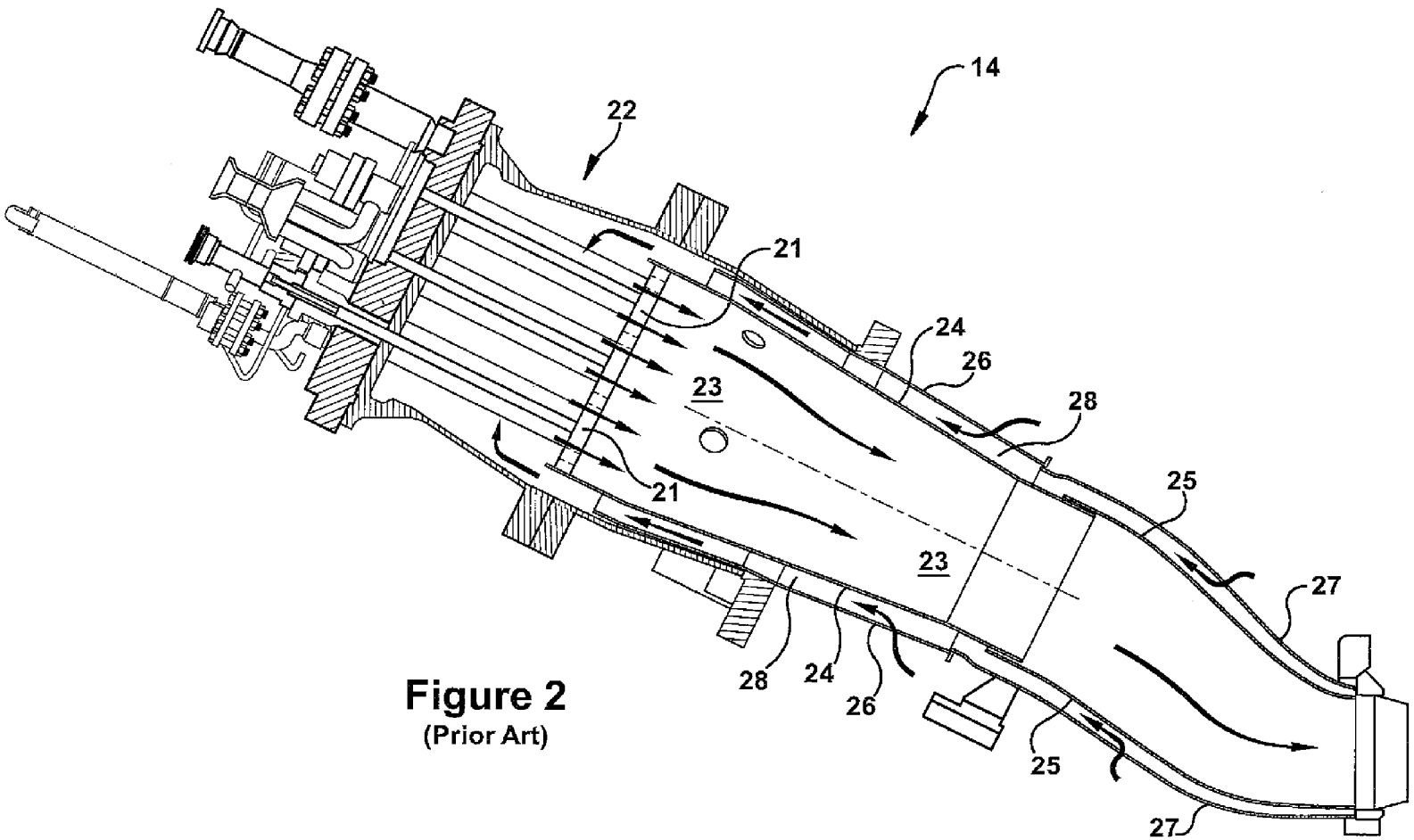
Figure 2 (Prior Art)
FIG. 2 is a section view of a conventional combustor.

FIG. 2 is a section view of a conventional combustor in which embodiments of the present invention may be used. Though the combustor 14 may take various forms, each of which being suitable for including various embodiments of the present invention, typically, the combustor 14 typically includes a head end 22, which includes multiple fuel nozzles 21 that bring together a flow of fuel and air for combustion within a primary combustion zone 23, which is defined by a surrounding liner 24. The liner 24 typically extends from the head end 22 to a transition piece 25. The liner 24, as shown, is surrounded by a flow sleeve 26. The transition piece 25 is surrounded by an impingement sleeve 27. Between the flow sleeve 26 and the liner 24, as well as between the transition piece 25 and impingement sleeve 27, it will be appreciated that an annulus is formed. This annulus will be referred to herein as a "flow annulus 28" or "annulus 28". The flow annulus 28, as shown, extends for most of the length of the combustor 14. From the liner 24, the transition piece 25 transitions the flow from the circular cross section of the liner 24 to an annular cross section as the transition piece 25 extends downstream toward a connection made with the turbine section 16 of the engine. At this connection, the transition piece 25 directs the flow of the working fluid toward the airfoils that are positioned in the first stage of the turbine 16.

It will be appreciated that the flow sleeve 26 and impingement sleeve 27 typically has impingement apertures (not shown) formed therethrough which allow an impinged flow of compressed air from the compressor 12 to enter the flow annulus 28 formed between the flow sleeve 26/liner 24 and/or the impingement sleeve 27/transition piece 25. The flow of compressed air through the impingement apertures convectively cools the exterior surfaces of the liner 24 and transition piece 25, though, as discussed earlier, cross flow through the annulus 28 can negatively impact the effectiveness of this type of cooling. The compressed air entering the combustor 14 through the flow sleeve 26 and the impingement sleeve 27 is directed toward the forward end of the combustor 14 via the flow annulus 28 formed about the liner 24. The compressed air then enters the fuel nozzles 21, where it is mixed with a fuel for combustion within the combustion zone 23. As noted above, the turbine engine 10 includes a turbine 16 having circumferentially spaced rotor blades, into which products of the combustion of the fuel in the combustor 14 are directed. The transition piece 25 directs the flow of combustion products of the liner 24 into the turbine 16, where it interacts with the rotor blades to induce rotation about the shaft, which, as stated, then may be used to drive a load, such as a generator. Thus, the transition piece 25 serves to couple the combustor 14 and the turbine 16. In systems that include late lean fuel injection or axial fuel staging, it will be appreciated that the transition piece 25 also may define a secondary combustion zone in which additional fuel supplied thereto is combusted, which may increase the cooling needs within this area of the combustor 14.

Figure 3:
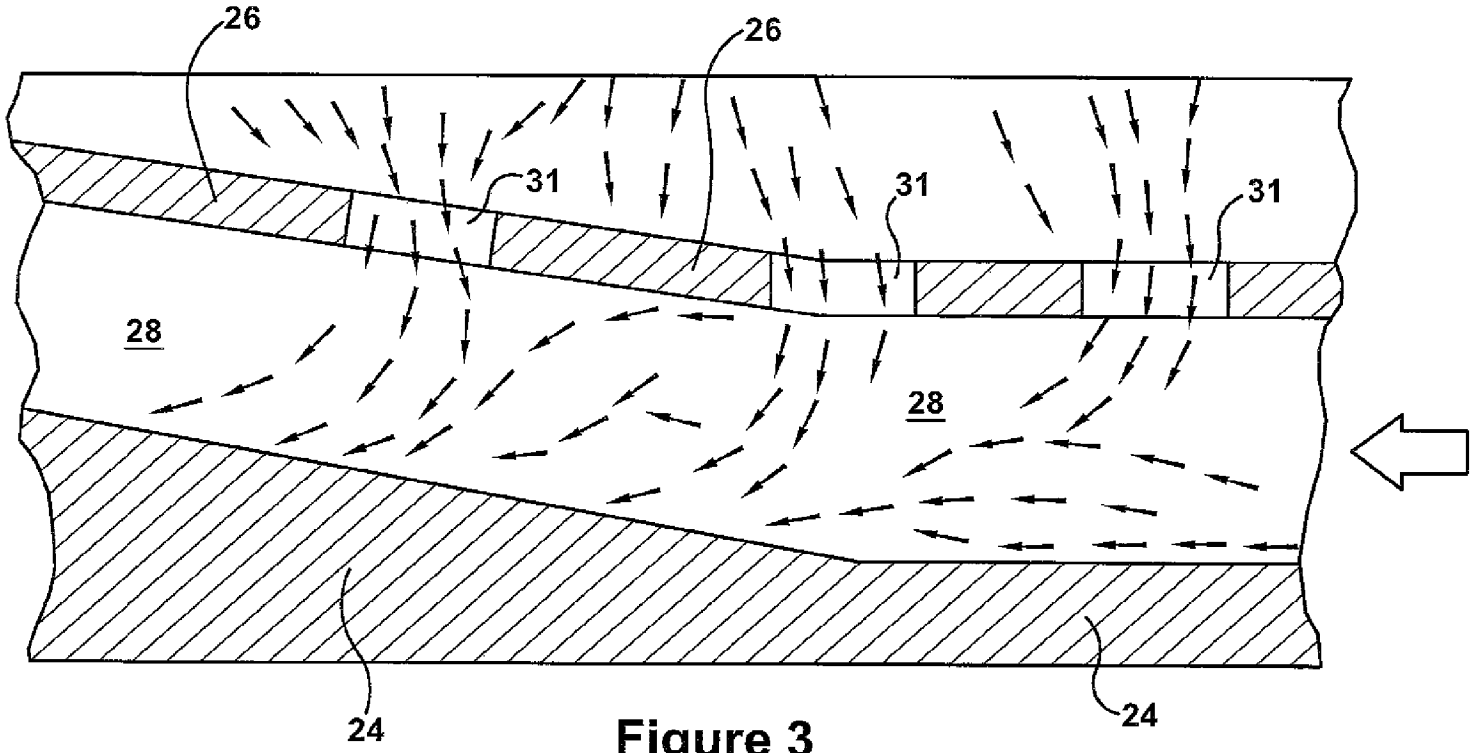
Figure 3 (Prior Art)
FIG. 3 is a simplified cross-sectional view of a flow annulus showing impingement cooling of the combustor liner according to a conventional cooling arrangement.

With reference now to FIG. 3, a close-up is provided of a typical combustor 14 that includes a liner 24 defining a combustion zone 23, and a flow annulus 28 defined between the liner 24 and a flow sleeve 26. As stated, flow of compressed air from the compressor 12 is directed into a compressor discharge case (not depicted) from which it typically enter the flow annulus 28 formed along the length of the combustor 14 via many impingement ports 31 formed through flow sleeves 26, 27. As the many arrows of FIG. 3 demonstrate, cross flow may develop within the flow annulus 28 in a direction perpendicular to impingement cooling air entering the sleeves 26, 27 through the impingement ports 31. It will be appreciated that the cross flow may deflect the impinged cooling jets so to degrades their ability to impinge upon the liner 24. Depending on the relative strengths of the cross flow and jets, the jet flow from the impingement ports 31 may not even reach the outboard surface of the combustor liner 24. As further shown, the cross flow may result in areas of laminar flow along the liner 24, which further reduces heat transfer between the coolant flowing through the annulus 28 and the liner 24.

Figure 5:
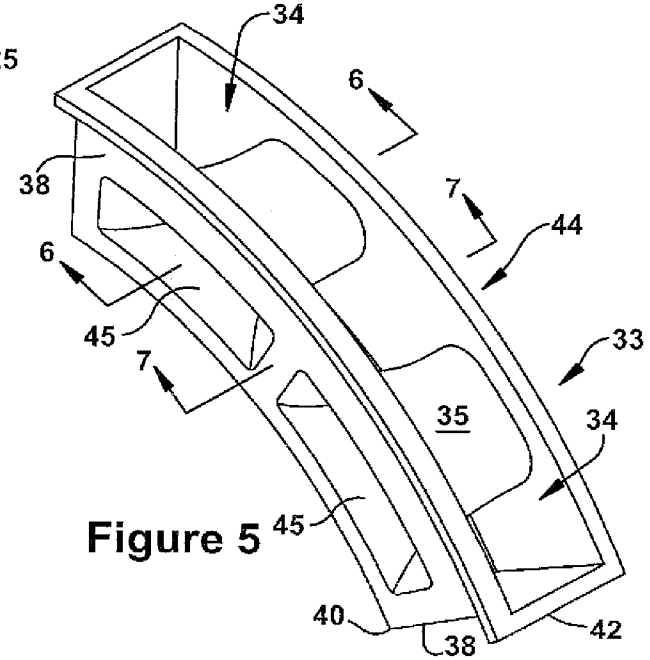
FIG. 5 is a perspective view of an annulus cooling socket according to aspects of the present invention.
Figure 4:
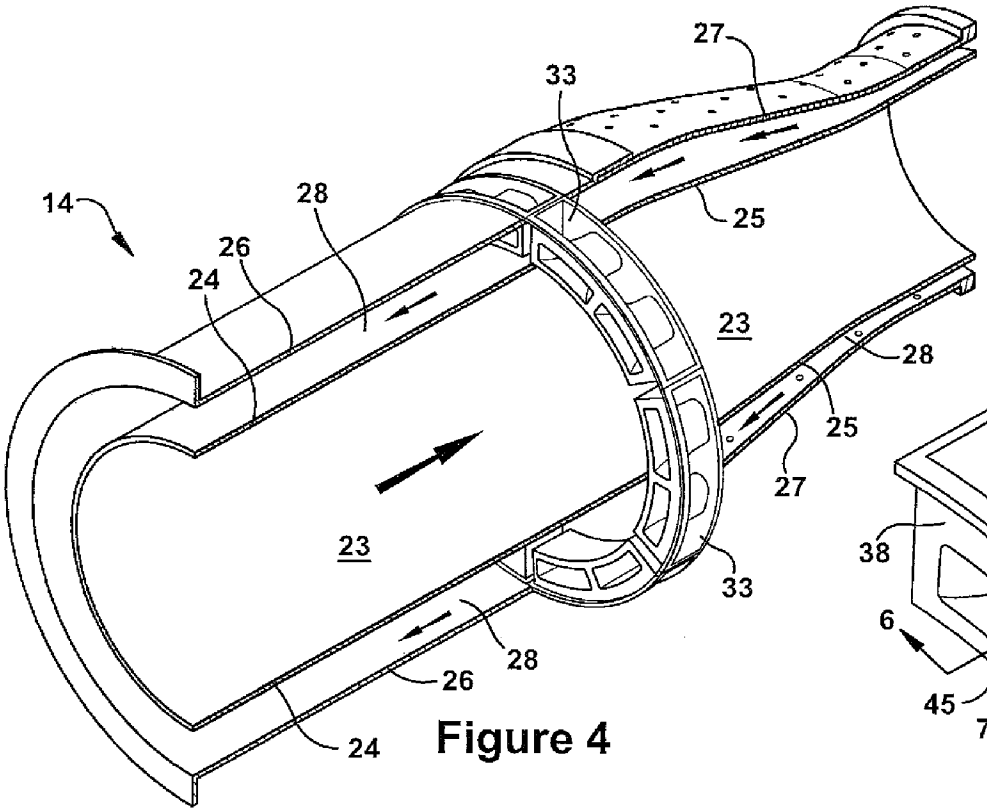
FIG. 4 is a perspective with partial cross-sectional view of a combustor having annulus cooling sockets according to aspects of the present invention.

FIG. 4 is a perspective with partial cross-sectional view of a combustor having annulus cooling sockets 33 according to aspects of the present invention. As shown, one embodiment of the present invention includes three such annulus cooling sockets 33 that are circumferentially spaced on one side of the combustor 14. FIG. 5 is a perspective view of a single annulus cooling socket 33 according to aspects of the present invention, with FIGS. 6 and 7 providing cross-sectional views along lines 6-6 and 7-7 of FIG. 5, respectively. As shown in FIG. 4, exemplary embodiment of the present invention may be used within the liner 24/flow sleeve 26 assembly or the transition piece 25/impingement sleeve 27 assembly or at the junction between these two assemblies. Accordingly, the description herein will be directed toward an "outer radial wall" and an "inner radial wall". It will be appreciated, though, that, unless stated otherwise, reference to the "outer radial wall" includes the flow sleeve 26, the impingement sleeve 27, or other similar situated component, and reference to the "inner radial wall" includes the liner 24, the transition piece 25, or other similarly situated component.

The present invention includes a cooling configuration within a combustor 14 that includes an inner radial wall, which defines a combustion chamber 23 downstream of a primary fuel nozzle 21, and an outer radial wall, which surrounds the inner radial wall so to form a flow annulus 28 therebetween. The cooling assembly includes an annulus cooling socket ("socket 33") that extends from the outer radial wall so that the socket 33 juts into the flow annulus 28. As shown in FIGS. 4 through 10, the socket 33 may include a mouth 31 formed through the outer radial wall, and a floor 40 offset a predetermined distance from an outboard surface of the inner radial wall. Impingement ports 31 may be formed through the floor 40.

The socket 33 further may include an axial nozzle 35. The axial nozzle 35 may comprise a tube-like structure that extends through a hollow interior of the socket 33. The axial nozzle 35 may be aligned so that flow through it has a substantial axial component (relative to a center axis of the combustor 14). In certain preferred embodiments, the tube of the axial nozzle 35 may be canted in an inboard direction so that fluid moving therethrough is trained upon the outboard surface of the inner radial wall.

As illustrated, other than the axial nozzles 35 that span across the socket 33, the socket 33 may have a substantial hollow interior that is defined by sidewalls extending between the outer radial wall and the floor 40 of the socket 33. The sidewalls may include an upstream section 37, which is positioned toward the aft end of the combustor 11, and a downstream section 38, which is positioned toward the forward end of the combustor 14. The upstream section 37 and the downstream section 38, as shown, may be oriented approximately perpendicular to the flow direction of fluid through the flow annulus 28, each being offset from the other by the axial width of the socket 33.

Figure 6:
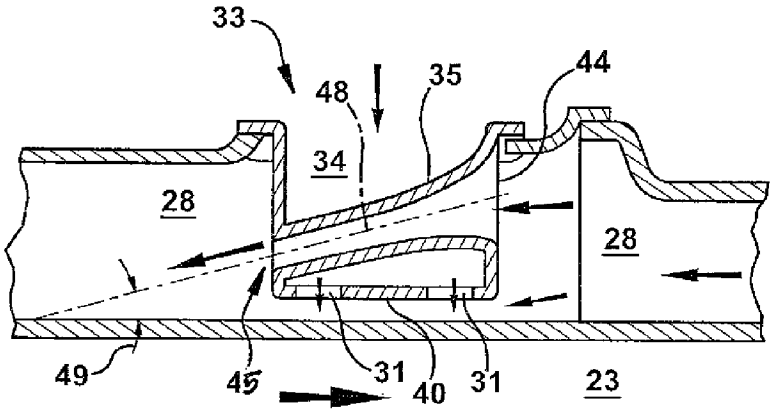
FIG. 6 is a cross-sectional view along line 6-6 of FIG. 5.

Described in relation to the upstream 37 and downstream sections 38 of sidewalk and the floor 40, the axial nozzle 35 according the present invention may have at least two different configurations. In a first embodiment, as illustrated in FIG. 6, the axial nozzle 35 may be described as a tube structure, or tube stretching between an inlet port 44 formed on the upstream section 37 and an outlet port 45 formed on the downstream section 38 of the sidewalls. In a second embodiment, as illustrated in FIG. 8, the axial nozzle 35 may be described as having a tube structure or tube stretching between an inlet port 44 formed on the upstream section 37 and an outlet port 45 formed through the floor 40 of the socket 33.

Figure 8:
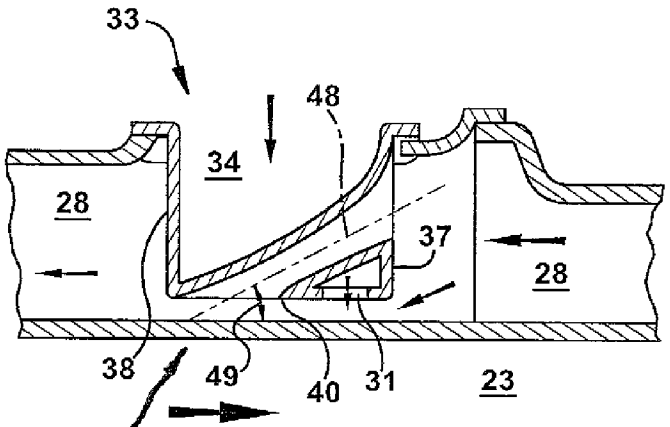
FIG. 8 is a side cross-sectional view of an alternative annulus cooling socket according to aspects of the present invention.
Figure 9:
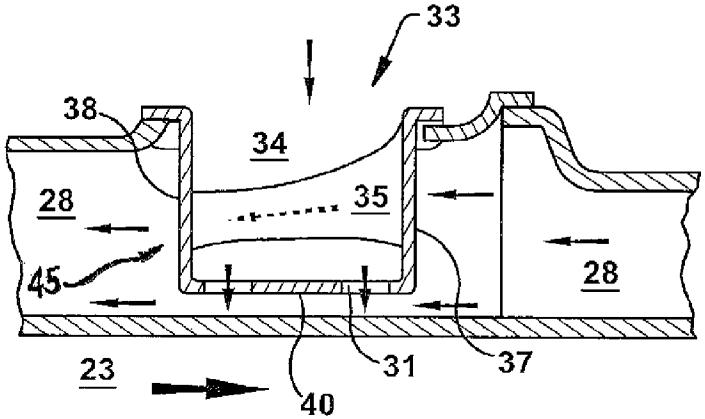
FIG. 9 is a side cross-sectional view of an alternative annulus cooling socket according to aspects of the present invention.

As indicated in FIGS. 6 and 8, the tube of the axial nozzle 35 may be configured to have a center axis 48 that is substantially linear. The axial nozzle 35 may be configured such that the center axis 48 is canted in an inboard direction. As shown in FIGS. 6 and 8, in such cases, an angle 49 may be formed between: a) a reference line comprising a forward continuation of the center axis of the tube; and b) the outboard surface of the outer radial wall. It will be appreciated that the angle 49 may be steeper in embodiments having a configuration similar to FIG. 8 than in those of FIG. 6. In certain preferred embodiments of the configuration of FIG. 6, the axial nozzle 35 may be configured such that the angle 49 is between 0° and 45°. In certain preferred embodiments of the configuration of FIG. 8, the axial nozzle 35 may be configured such that the angle 49 is between 20° and 60°. In an alternative embodiment, such as the embodiment of FIG. 9, the axial nozzle 35 may be more axially oriented. More specifically, as illustrated in FIG. 9, the inboard cant of the axial nozzle may not be included.

It will be appreciated that the sidewalls of the socket 33 deliver coolant from the mouth 34 formed through the outer radial wall to the floor 40 positioned within the annulus 28 while shielding the coolant from the cross flow moving through the annulus 28. In this manner, the sidewalls of the socket 33 may be described as including solid or separating structure that isolates: a) a first fluid moving between the mouth 34 of the socket 33 and the impingement ports 31 formed through the floor 40; and b) a second fluid exterior of the socket 33 that is moving through the annulus 28. Similarly, the tube of the axial nozzle 35 includes solid or separating structure that may be described as isolating: a) a third fluid flowing through the interior of the tube of the axial nozzle 35; and b) the first fluid moving between the mouth 34 of the socket 33 and the impingement ports 31 of the floor 40. It will be appreciated that separation of the differing flows in this manner allows for coolant to be impinged against the outer radial wall so that its cooling efficiency is increased. Specifically, the impingement ports 31 are positioned closer to the inner radial wall (i.e., the liner 24 or the transition piece 25) and axial nozzles 35 provide an alternative and isolated path for cross flow to travel that might otherwise interfere with the release of impinged coolant, both of which function to increase the effectiveness of the coolant entering the annulus 28 at this location. Additionally, the inboard cant of the axial nozzle 35, discussed above, redirects cross flow toward the outboard surface of the inner radial wall so that further cooling performance advantages may be achieved.

In certain embodiments, the socket 33 is positioned so that it corresponds favorably to a known hot spot on the inner radial wall. More specifically, the positioning of the socket 33 may results in the aiming of the impingement ports 31 toward the hot spot on the inner radial wall. In other embodiments, the positioning of the socket 33 may results in the axial nozzle 35 being aimed at the hot spot. It will be appreciated that the offset between the floor 40 and the inner radial wall may be configured to correspond to a desirable impingement cooling characteristic at the outboard surface of the inner radial wall.

In certain embodiments, the inner radial wall is the liner 24 and the outer radial wall is the flow sleeve 26. In other embodiments, the inner radial wall is the transition piece 25 and the outer radial wall is the impingement sleeve 27.

The outer radial wall, which, as stated, may be either the flow sleeve 26 or the impingement sleeve 27, may have an approximate circular cross-sectional shape. In certain embodiments, as illustrated in FIG. 5, the socket 33 may be configured as a circumferential segment of the outer radial wall. In certain embodiments, the circumferential segment has a circumferential span of less than 90 degrees. In certain embodiments, the circumferential segment has an approximate rectangular profile. The rectangular profile may include a wide dimension and a narrow dimension. The socket 33 may be configured such that the wide dimension of the rectangular profile extends circumferentially and the narrow dimension extends axially, as illustrated in FIG. 4.

In certain embodiments, the combustor cooling configuration of the present invention include a plurality of non-integral sockets 33 where each of the sockets 33 is a circumferential segment disposed adjacent to one of the other sockets 33. The adjacent sockets 33 may extend in a circumferential direction. In this type of configuration, as shown in FIG. 4, each of the circumferential segments may have a circumferential span of less than 90 degrees, and each of the sockets 33 may include two axial nozzles 35. In relation to each other, the two axial nozzles 35 of each socket 33 may be circumferentially spaced, as shown. The plurality of sockets 33 may be configured to form a belt that circumscribes at least a majority of the flow annulus 28. The axial position of the belt may be one near a junction between a liner 24 and the transition piece 25.

Figure 10:
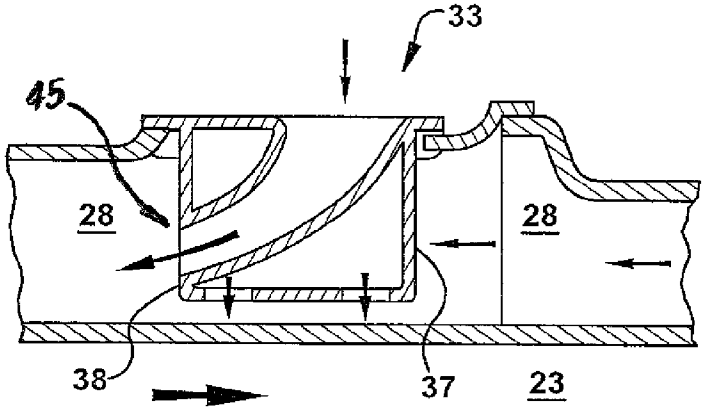
FIG. 10 is a side cross-sectional view of an alternative annulus cooling socket according to aspects of the present invention.

FIG. 10 is a side cross-sectional view of an alternative annulus cooling socket according to aspects of the present invention. As illustrated, in this instance, a radial-to-axial inducer is provided that accepts a flow of air from outside the combustor and turns the flow from an almost purely radial direction, to a more axial direction.

It is well known that in heavy industrial gas turbines that operate at relatively low synchronous speeds the fluid mechanics of the compressor and turbine dictate location of the combustion system and first stage nozzle outboard from the compressor discharge. In order to minimize the span between the rotor bearings, the compressor discharge is also located in a plane aft of the head end of the combustion system. These factors result in a biased static pressure and flow distribution between the inner radial portion of the liner/now sleeve annulus and the portion of that annulus on the outer radial side of the combustion system. In certain embodiments, the invention of the present application may have a circumferentially uniform distribution of annulus cooling sockets 33. However, in other embodiments, in order to create a more uniform static pressure and air flow distribution for improved cooling of the liner and more uniform air feed into the fuel premixers, the annulus cooling sockets 33 may be distributed non-uniformly on the inner radial and outer radial parts of the circumference of the combustor in order to reduce this circumferential non-uniformity in flow distribution common in such engine architectures. In this manner, the belt of annulus cooling sockets 33 may act as a can-level inlet flow conditioner for a more uniform feeding of the gas premixers in the head end of the combustor.

As shown in FIGS. 4 and 5, in certain preferred embodiments, the axial nozzle 35 may have a diffuser geometry. As shown in FIGS. 4 and 5, this may mean that the sidewalls of the axial nozzle 35 smoothly diverge in the downstream direction. And/or, as shown partially in FIG. 8, this may mean that the inboard/outboard walls of the axial nozzle 35 smoothly diverge in the downstream direction. In this manner, the axial nozzle 35 may be configured so that the cross-sectional flow area of the axial nozzle 35 increases as it extends in the downstream direction. It will be appreciated that, having this configuration, the flow through the axial nozzles 35 diffuses smoothly from the higher upstream total pressure to the downstream higher static pressure, without flow separation that would create additional pressure losses with no cooling benefits. Further, as one of ordinary skill in the art will appreciate, the presence of the annulus cooling sockets 33 in the liner/flow sleeve annulus creates a wake downstream of each segment. These wakes result in additional circumferential stirring of the fluid and enhanced convection and cooling effectiveness in that portion of the annulus downstream of the socket 33 array.

In certain embodiments, as shown most clearly in FIGS. 4 and 5, gaps may be formed between neighboring segments in which the annulus cooling sockets 33 are formed. The gaps may be simply uniform, with no variation in the cross-sectional area, either in the direction of the flow or perpendicular to it. It will be appreciated that, because the gaps between the segments are part of an annulus, the flow area increases moving outboard if the space between the segments is constant. Additional performance advantages, in terms of reducing pressure losses, improving cooling effectiveness, and/or improving the distribution of the flow and cooling circumferentially, by tailoring the shape of these gaps. For example, for more uniform velocity, the gaps between segments may be wider on the inner radial side and narrower toward the outboard side so that the flow area of the gap is constant from the inner side of the gap to the outer side. The gaps may be configured to expand smoothly outward (i.e., increase in cross-sectional flow area) as the gap extends axially downstream, similar to the configuration described above in reference for the axial nozzles 35, which may be done for the same reason of acting as a diffuser. It will be appreciated that the re-distribution of flow, wakes and circumferential stirring may also be impacted and optimized by the shape and distribution of the gaps between the segments.

It will further be appreciated that heat transfer in internal flows may be enhanced by entrance length effects by preventing the flow from becoming fully developed in terms of the velocity profile via interrupting the flow path periodically. Accordingly, in certain embodiments of the present invention, the positioning of the annulus cooling sockets 33 may be staggered axially and circumferentially, rather than the continuous circumferentially extending belt that maintain the same axial position.

Figure 7:
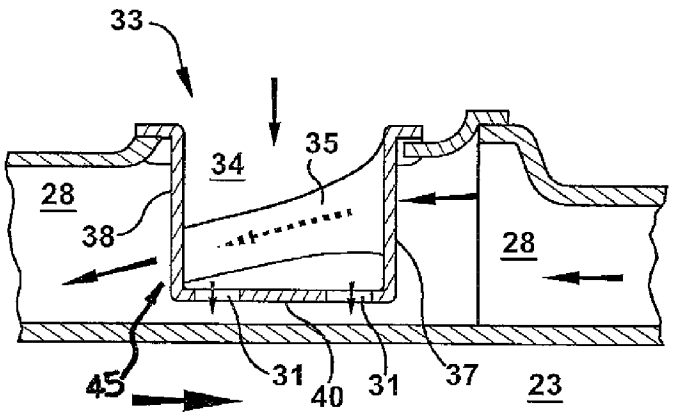
FIG. 7 is a cross-sectional view along line 7-7 of FIG. 5.

The radial height of the annulus cooling socket 33 may be uniform, as illustrated in FIGS. 6, 7, and 8. In other embodiments, the radial height may be non-uniform. That is, the radial distance between the floor of the cooling socket 33 and the outside of the liner may be varied. In certain embodiments, the radial height may converge toward the liner (i.e., decrease) as the cooling socket 33 extends axially downstream. In other embodiments, the radial height may diverge away from the liner (i.e., increase) as the cooling socket 33 extends axially downstream. The radial height may also be varied circumferentially around the liner to more evenly distribute the flow of compressor discharge air for improved liner cooling and reduced thermal gradients and thermal stress. The impingement holes 31 also may be staggered. The impingement hole distribution and the gap may be manipulated to minimize the pressure loss for a given level of cooling effectiveness.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A cooling configuration within a combustor of a combustion turbine engine, wherein the combustor includes an inner radial wall, which defines a combustion chamber downstream of a primary fuel nozzle, and an outer radial wall, which surrounds the inner radial wall so to form a flow annulus therebetween, the cooling assembly comprising:

a socket extending from the outer radial wall into the flow annulus;

wherein the socket includes:

a mouth formed through the outer radial wall;

a floor offset a predetermined, distance from an outboard surface of the inner radial wall;

impingement ports formed through the floor; and an axial nozzle;

wherein the axial nozzle comprises:

a tube that extends through a hollow interior of the socket, the axial nozzle comprising an approximate axial orientation in relation to a center axis of the combustor; and wherein the tube of the axial nozzle is canted in an inboard direction.

2. The combustor cooling configuration of claim 1, wherein the socket comprises a hollow interior defined by sidewalls, the sidewalls extending between the outer radial wall and the floor;

wherein the sidewalk include an upstream section; and wherein the axial nozzle comprises a tube stretching between an in formed on the upstream section and an outlet port formed through the floor.

3. The combustor cooling configuration of claim 2, wherein the tube of the axial nozzle comprises a center axis that is substantially linear;

wherein an angle is formed between: a) a reference line comprising a forward continuation of the center axis of the tube; and b) the outboard surface of the outer radial wall; and wherein the angle comprises between 20° and 60°.

4. The combustor cooling configuration of claim 1, wherein the socket comprises a hollow interior defined by sidewalls, the sidewalls extending between the outer radial wall to the floor;

wherein the sidewalks include an upstream section and a downstream section; and wherein the axial nozzle comprises a tube stretching between an inlet port formed on the upstream section and an outlet port formed on the downstream section.

5. The combustor cooling configuration of claim 4, wherein the tube of the axial nozzle comprises a center axis that is substantially linear; and wherein the tube is configured such that the center axis is canted in an inboard direction.

6. The combustor cooling configuration of claim 5, wherein an angle is formed between: a) a reference line comprising a forward continuation of the center axis of the tube; and b) the outboard surface of the outer radial wall; and wherein the angle comprises between 0° and 45°.

7. The combustor cooling configuration of claim 1, wherein the sidewalls of the socket comprise separating structure that separates: a) a first fluid moving between the mouth of the socket and the impingement ports formed through the floor; and b) a second fluid moving around an exterior of the socket; and wherein the tube of the axial nozzle comprises separating structure that isolates: a) third fluid flowing through an interior of the tube of the axial nozzle; and b) the first fluid moving between the mouth of the socket and the impingement ports formed through the floor; and wherein the upstream section and the downstream section are oriented approximately perpendicular to a fluid flow direction through the flow annulus, each being offset from the other by an axial width of the socket.

8. The combustor cooling configuration of claim 1, wherein the outer radial wall comprises an approximate circular cross-sectional shape; and wherein the socket comprises a circumferential segment of the outer radial wall.

9. The combustor cooling configuration of claim 8, wherein the circumferential segment has a circumferential span of less than 90°;

wherein the circumferential segment comprises an approximate rectangular profile that includes a wide dimension and a narrow dimension; and wherein the socket is configured such that the wide dimension of the rectangular profile extends circumferentially and the narrow dimension extends axially.

10. The combustor cooling configuration of claim 8, wherein the combustor cooling configuration further comprises a plurality of sockets, each of which comprises a circumferential segment disposed adjacent to each other in a circumferential direction.

11. The combustor cooling configuration of claim 10, each of the circumferential segments comprises a similar circumferential span of less than 90°;

wherein each of the sockets includes two axial nozzles; and wherein, in relation to each other, the two axial nozzles of each socket are circumferentially spaced.

12. The combustor cooling configuration of claim 8, wherein the plurality of sockets are configured to form a belt that circumscribes at least a majority of the flow annulus; and wherein an axial position of the belt comprises one near a junction between a liner and a transition piece of the combustor.

13. The combustor cooling configuration of claim 1, wherein a positioning of the socket corresponds to a hot spot on the inner radial wall; and wherein the positioning of the socket results in the impingement ports being aimed at the hot spot on the inner radial wall.

14. The combustor cooling configuration of claim 1, wherein the offset comprises a distance that corresponds to a desirable impingement cooling characteristic at the outboard surface of the inner radial wall; and wherein the inner radial wall comprises a liner and the outer radial wall comprises a flow sleeve.

15. The combustor cooling configuration of claim 1, wherein a positioning of the socket corresponds to a hot spot on the inner radial wall; and wherein the positioning of the socket results in the axial nozzle being aimed at the hot spot on the inner radial wall.

16. The combustor cooling configuration of claim 1, wherein the offset comprises a distance that corresponds to a desirable impingement cooling characteristic at the outboard surface of the inner radial wall; and wherein the inner radial wall comprises a transition piece and the outer radial wall comprises an impingement sleeve.

17. The combustor cooling configuration of claim 1, wherein a radial height of the socket is configured to vary circumferentially to produce a more even flow of air through the flow annulus.

18. The combustor cooling configuration of claim 1, wherein a radial height of the socket is configured to vary axially such that a distance between the floor and the inner radial wall increases as the socket extends axially downstream.

19. The combustor cooling configuration of claim 1, wherein the axial nozzle comprises a diffuser geometry; and wherein the diffuser geometry of the axial nozzle comprises at least one of: a) sidewalk diverging as the axial nozzle extends in a downstream direction; and b) an inboard wall and an outboard wall diverging as the axial nozzle extends in a downstream direction.

20. The combustor cooling configuration of claim 10, wherein the plurality of sockets comprise a non-uniform distribution about a circumference of the flow annulus, the non-uniform distribution comprising a configuration that produces a more uniform flow distribution within the flow annulus given an expected circumferential non-uniformity in air about the outer radial wall during operation.

21. A combustor in a combustion turbine engine, the combustor comprising:

an inner radial wall, which defines a combustion chamber downstream of a primary fuel nozzle;

an outer radial wall, which surrounds the inner radial wall so to form a flow annulus therebetween, a cooling assembly that includes:

a socket that extends from the outer radial wall into the flow annulus, the socket having a mouth formed through the outer radial wall;

a floor of the socket that is positioned a predetermined offset distance from an outboard surface of the inner radial wall;

impingement ports formed through the floor; and an axial nozzle that includes a tube stretching between an inlet port formed on an upstream side of the socket and an outlet port, the axial nozzle having an inboard cant.

22. The combustor of claim 21, wherein the combustor comprises an approximate circular cross-sectional shape;

further including a plurality of the cooling assemblies, each of which comprises a circumferential segment disposed adjacent to each other and extending in a circumferential direction;

wherein the plurality of cooling assemblies are configured to form a belt that circumscribes at least a majority of the flow annulus; and wherein an axial position of the belt comprises one near an aft end of the liner.

* * * * *